US005499803A

United States Patent [19]

Farr

[11] Patent Number: 5,499,803

[45] Date of Patent: Mar. 19, 1996

[54] COLLATOR WITHOUT A MAIN LINE DRIVE SHAFT

[75] Inventor: Alan S. Farr, Huber Heights, Ohio

[73] Assignee: AM International, Inc., Mt. Prospect, Ill.

[21] Appl. No.: 344,499

[22] Filed: Nov. 23, 1994

[51] Int. Cl.[6] ..... B65H 39/02; B65H 3/44

[52] U.S. Cl. ..... 270/54; 270/58; 271/9.012

[58] Field of Search ..... 270/54, 58; 271/9.01, 271/9.12, 9.13

[56] References Cited

U.S. PATENT DOCUMENTS

| | | | |
|---|---|---|---|
| 3,825,247 | 7/1974 | Fernandez-Rana et al. | 270/58 |
| 5,013,022 | 5/1991 | Graushar | 270/54 X |
| 5,067,697 | 11/1991 | Honegger | 270/54 X |
| 5,100,116 | 3/1992 | Graushar | 270/54 X |
| 5,141,216 | 8/1992 | Ballestrazzi et al. | 271/9.01 X |
| 5,203,549 | 4/1993 | Bryson, Sr. et al. | 270/58 X |
| 5,253,857 | 10/1993 | Ballestrazz et al. | 271/9.12 X |

FOREIGN PATENT DOCUMENTS

| | | | |
|---|---|---|---|
| 61-229771 | 10/1986 | Japan | 270/58 |

*Primary Examiner*—John E. Ryznic

*Attorney, Agent, or Firm*—Tarolli, Sundheim & Covell

[57] ABSTRACT

A collator (10) comprises a collating conveyor (12) and a plurality of hopper sections (20, 40, 60) located along the conveyor. Each section includes at least one signature pile support (21–24, 41–44, 61–64) for holding signatures to be fed to the conveyor. Each section also includes a signature feeder (25–28, 45–48, 65–68) for feeding a signature from the pile support to the conveyor. Each section has its own respective motor (32, 52, 72) for driving the associated feeder. Each motor includes its own respective controller (30, 50, 70) for controlling the associated motor to control the feeding of signatures from the associated feeder to the conveyor. Each controller includes its own respective motor drive for controlling operation of the associated motor. A master controller (14) interconnecting the motor drives controls speed of operation and coordinates timing of operation of the motor drives. Alternatively, each pile support (**21*a*–24*a*) could have its own respective feeder (25*a*–28*a*) for feeding a signature from the associated pile support to the conveyor (12*a*). In this case, each feeder would include its own respective motor (112, 122, 132, 144) for driving the associated feeder. Also, each motor would include its own respective controller (110, 120, 130, 140**) for controlling the associated motor to control the feeding of signatures from the associated feeder to the conveyor.

26 Claims, 2 Drawing Sheets

COLLATOR WITHOUT A MAIN LINE DRIVE SHAFT

TECHNICAL FIELD

The present invention relates to a collator having a plurality of signature feeders, and is particularly directed to such a collator without a main line drive shaft.

BACKGROUND OF THE INVENTION

Collators for assembling a plurality of signatures into groups of collated signatures, such as books or magazines, are well known in the art. A typical collator includes a single main line drive shaft which drives a collating conveyor and feeders which feed signatures to the collating conveyor. The feeders are spaced along the collating conveyor. The main line drive shaft has a longitudinal central axis and is rotatable about its longitudinal central axis. A drive motor is connected to one end of the main line drive shaft to drive the shaft about its longitudinal central axis. The feeders are drivingly connected to the main line drive shaft. The feeders are driven with proper timing to form the books or magazines on the collating conveyor.

Some disadvantages are present when a single main line drive shaft is used to drive a number of feeders spaced along a collating conveyor. One disadvantage is that the position of the feeders cannot be raised or lowered relative to the collating conveyor to better feed signatures onto the collating conveyor. This is because there are rigid mechanical connections between the main line drive shaft and the feeders.

Another disadvantage is that a single main line drive shaft may be relatively long and, therefore, may twist enough about its longitudinal central axis to cause the feeders located a distance from the drive motor to be out of proper timing. The main line drive shaft may twist about its longitudinal central axis because the drive motor driving the shaft may be located at only one end of the shaft. Another drive motor may be connected to the other end of the main line drive shaft to also drive the shaft, but additional cost and drive complexity would be incurred.

Still another disadvantage to a collator having a single main line drive shaft is that to inhibit operation of the feeders, typically mechanical parts are engaged to stop movement of a part. This results in wear of the mechanical parts.

Still another disadvantage is that the task of adjusting a particular feeder to accommodate delivery of a different-sized signature onto the collating conveyor is rather cumbersome. Such an adjustment typically requires the feeder to be first declutched from the single main line drive shaft and then the collating conveyor to be jogged until the desired adjustment is achieved. The feeder is then reclutched to the single main line drive shaft.

SUMMARY OF THE INVENTION

In accordance with one aspect of the present invention, a collator comprises a collating conveyor and a plurality of hopper sections located along the collating conveyor. Each hopper section includes at least one signature pile support for holding signatures to be fed to the collating conveyor. Each hopper section also includes signature feed means for feeding a signature from a signature pile support to the collating conveyor. Each hopper section has its own respective drive motor which drives the associated signature feed means. Each drive motor has its own respective control means which controls the feeding of signatures from the associated signature feed means to the collating conveyor.

Preferably, each control means includes its own respective motor drive which controls operation of the associated drive motor. A master controller interconnects the motor drives. The master controller controls operation and coordinates timing of operation of the motor drives.

In accordance with another aspect of the present invention, a collator comprises a collating conveyor and at least one of hopper section located along the collating conveyor. The hopper section includes a plurality of signature pile supports for holding signatures to be fed to the collating conveyor. Each signature pile support has its own respective signature feed means for feeding a signature from the associated signature pile support to the collating conveyor. Each signature feeder means includes its own respective drive motor for driving the associated signature feed means. Each drive motor includes its own respective control means for controlling the associated drive motor to control the feeding of signatures from the associated signature feed means to the collating conveyor.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF THE PREFERRED EMBODIMENT

Figure 1:
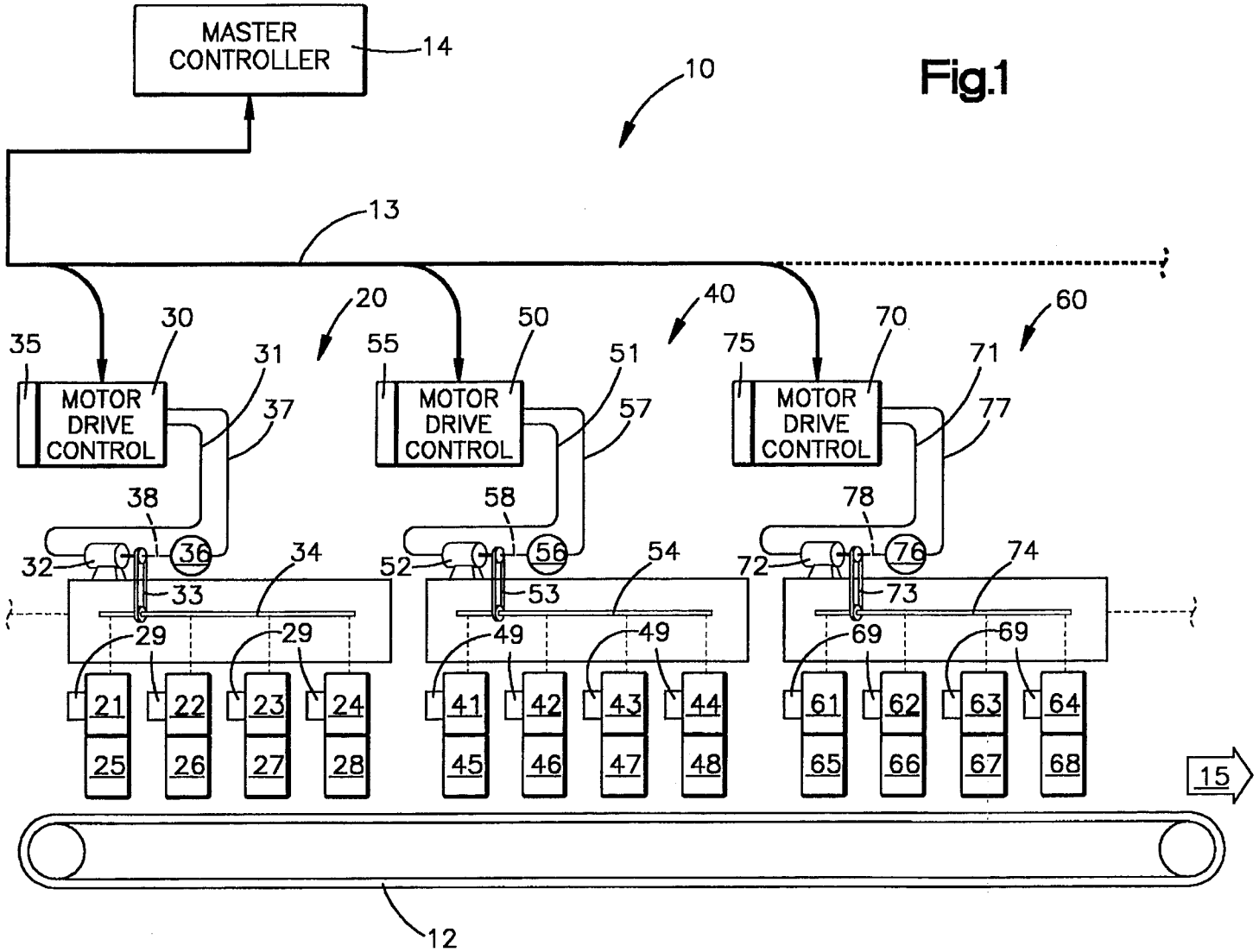
FIG. 1 is a schematic block illustration of a collator embodying the present invention.

The present invention is directed to a collator having a plurality of hopper sections. By way of example, the present invention is illustrated in FIG. 1 as embodied in a collator 10 including a collating conveyor 12 and having three hopper sections 20, 40, 60 for feeding signatures onto the conveyor 12. The hopper section 40 is adjacent to and downstream from the hopper section 20. The hopper section 60 is adjacent to and downstream from the hopper section 40.

The actual number of hopper sections of the collator 10 can be any number of hopper sections. For purposes of explanation, only the three hopper sections 20, 40, 60 are illustrated in FIG. 1. The conveyor 12 moves signatures in a direction indicated by the arrow 15.

Each of the hopper sections 20, 40, 60 includes four signature pile supports. Each of the signature pile supports has its own respective signature feeding mechanism. The hopper section 20 includes four signature pile supports 21, 22, 23, 24 and four feeding mechanisms 25, 26, 27, 28 associated with the four pile supports 21, 22, 23, 24, respectively. The hopper section 40 includes four signature pile supports 41, 42, 43, 44, and four feeding mechanisms, 45, 46, 47, 48 associated with the four pile supports 41, 42, 43, 44, respectively. The hopper section 60 includes four signature pile supports 61, 62, 63, 64 and four feeding mechanisms 65, 66, 67, 68 associated with the four pile supports 61, 62, 63, 64, respectively.

The hopper section 20 has its own respective set of jackscrews 29 which enable each of the signature pile supports 21, 22, 23, 24 and the respective feeding mechanisms 25, 26, 27, 28 to be raised or lowered relative to the conveyor 12. The hopper section 40 has its own respective set of jackscrews 49 which enable each of the signature pile supports 41, 42, 43, 44 and the respective feeding mechanisms 45, 46, 47, 48 to be raised or lowered relative to the conveyor 12. The hopper section 60 has its own respective set of jackscrews 69 which enable each of the signature pile supports 61, 62, 63, 64 and the respective feeding mechanisms 65, 66, 67, 68 to be raised or lowered relative to the conveyor 12.

The collator 10 further includes three motor drive controllers 30, 50, 70 and three motors 32, 52, 72 connected via electrical lines 31, 51, 71, respectively, to the three motor drive controllers 30, 50, 70. The three motors 32, 52, 72 are connected via couplings 33, 53, 73, respectively, to three section drive shafts 34, 54, 74. Each of the section drive shafts 34, 54, 74 is associated with a respective one of the hopper sections 20, 40, 60 and drives all of the feeding mechanisms in the particular hopper section to control the speed, acceleration, and timing coordination of the feeding mechanisms.

Three motor position encoders 36, 56, 76 are operatively coupled to the three motors 32, 52, 72, respectively, as shown schematically with dashed lines 38, 58, 78 in FIG. 1. The three encoders 36, 56,76 are connected via electrical lines 37, 57, 77, respectively, to the three motor drive controllers 30, 50, 70. A master drive controller 14 is connected via electrical line 13 to the three motor drive controllers 30, 50, 70.

Each of the motor drive controllers 30, 50, 70 has its own respective memory 35, 55, 75 which stores information about the associated hopper section. For example, the stored information may include information relating to the sizes of the signatures being fed to the conveyor 12 in the different hopper sections. The stored information could be processed by the associated motor drive controller to provide a signal which controls the associated motor so that the motor would be operated to either advance or retard the associated section drive shaft to proper position depending upon the size of the signatures being fed to the conveyor 12 in the particular hopper section. The size information stored in each memory may be downloaded from the master drive controller 14.

A number of advantages result by connecting a section drive shaft to all of the feeders of only one hopper section and using a respective motor drive controller to control operation of the feeders in the particular hopper section. One advantage is that improper timing of feeder operation due to twisting of a shaft is significantly reduced since each hopper section has its own respective relatively short section drive shaft as compared to a relatively long single main line drive shaft. Another advantage is that installation is relatively easier because of reduced alignment difficulties.

Figure 2:
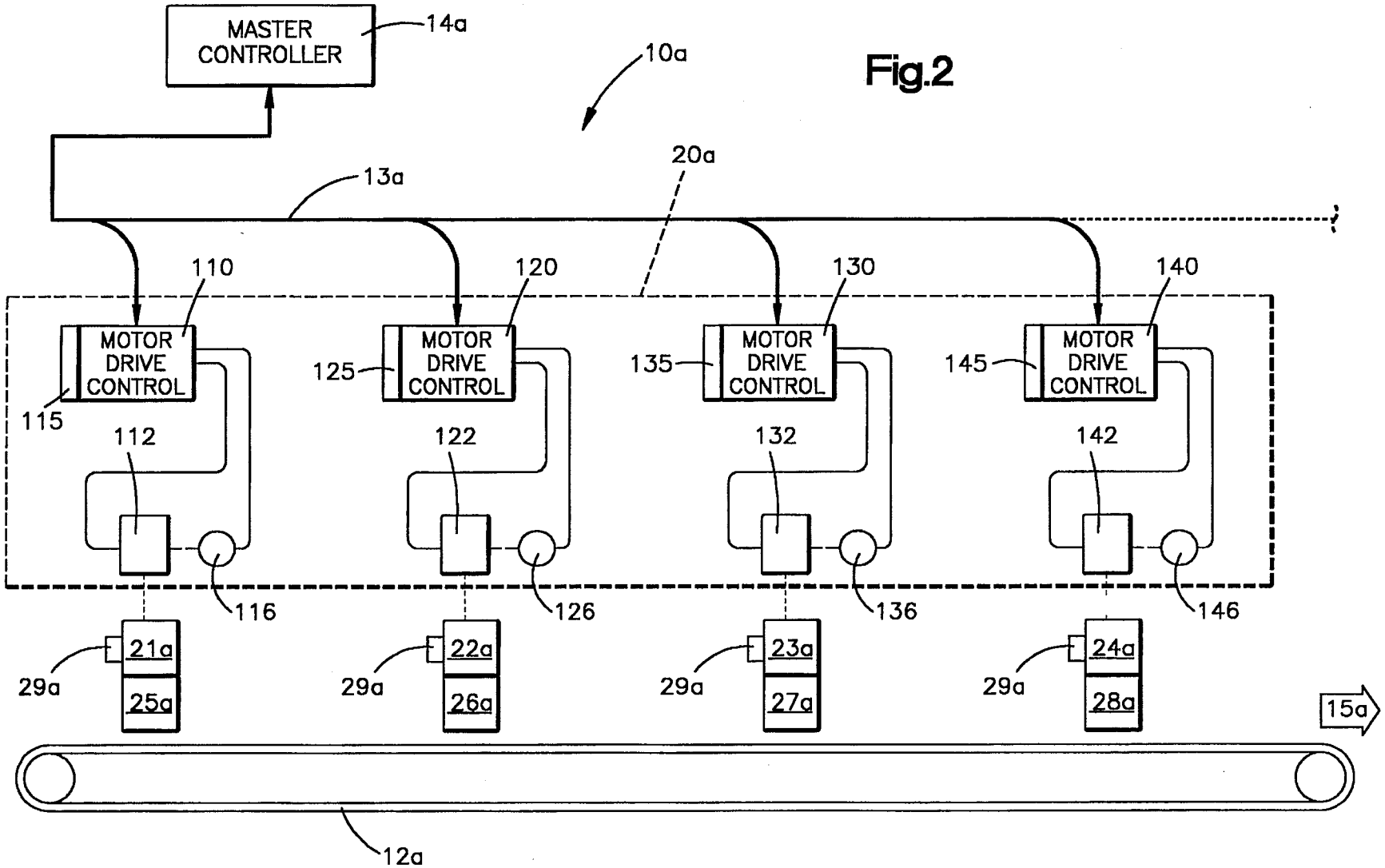
FIG. 2 is a schematic block illustration similar to FIG. 1 and illustrating another embodiment of the present invention.

Another embodiment of the present invention is illustrated in FIG. 2. Since the embodiment of the invention illustrated in FIG. 2 is generally similar to the embodiment illustrated in FIG. 1, similar numerals are utilized to designate similar components, the suffix letter "a" being associated with the embodiment of FIG. 2 to avoid confusion.

Referring to FIG. 2, the hopper section **20*a* includes the four signature pile supports 21*a*, 22*a*, 23*a*, 24*a* and the four feeding mechanisms 25*a*, 26*a*, 27*a*, 28*a* associated with the four pile supports 21*a*, 22*a*, 23*a* 24*a*, respectively. The hopper section 20*a* has the set of jackscrews 29*a* which enable each of the signature pile supports 21*a*, 22*a*, 23*a*, 24*a* to be moved relative to the conveyor 12*a***.

The shafts of four motors 112, 122, 132, 142 are directly connected to the four feeding mechanisms **25*a*, 26*a*, 27*a*, 28*a*, respectively, to drive and control the speed, acceleration, and timing coordination of the feeding mechanisms. Four motor position encoders 116, 126, 136, 146 are operatively coupled to the four motors 112, 122, 132, 142, respectively, as shown schematically with dashed lines 118, 128, 138, 148 in FIG. 2. The four motors 112, 122, 132, 142 are connected via electrical lines 111, 121, 131, 141, respectively, to four motor drive controllers 110, 120, 130, 140. The four encoders 116, 126, 136, 146 are connected via electrical lines 117, 127, 137, 147, respectively, to the four motor drive controllers 110, 120, 130, 140. The master controller 14*a* is connected via electrical line 13*a* to the four motor drive controllers 110, 120, 130, 140**.

It should be apparent that each feeding mechanism has its own respective motor and its own respective motor drive controller for controlling the associated motor to control the feeding of signatures from the associated signature pile support to the collating conveyor **12*a*. The motor 112 and the motor drive controller 110 control operation of the feeding mechanism 21*a*. The motor 122 and the motor drive controller 120 control operation of the feeding mechanism 22*a*. The motor 132 and the motor drive controller 130 control operation of the feeding mechanism 23*a*. The motor 142 and the motor drive controller 140 control operation of the feeding mechanism 24*a***.

A number of advantages result by providing a separate motor drive controller for each feeding mechanism and signature pile support. One advantage is that each feeder can be selectively inhibited from feeding signatures by inhibiting operation of the associated motor with the associated motor drive controller. By selectively inhibiting operation of the motors for the feeders which are not feeding any signatures, unnecessary wear and tear on these feeders are avoided.

Another advantage is that each feeder can be adjusted easily independently of other feeders. Each feeder can be adjusted using only the associated jackscrews since there is no mechanical connection to a single main line drive shaft. Each feeder can be raised or lowered and/or moved in or out and/or moved left or right. This flexibility provides on the fly phasing to adjust between feeding of signatures and can improve the way a signature is fed onto the conveyor **12*a***. This flexibility also allows the spacing between adjacent signature pile supports and feeding mechanisms to be easily changed.

Still another advantage is that installation and removal of parts for servicing are relatively easy since there is no mechanical drive connection between the motors 112, 122, 132, 142 and the feeding mechanisms **25*a*, 26*a*, 27*a*, 28*a*, respectively. Also, since there is no main drive motor, additional signature pile supports and feeding mechanisms can be provided along the conveyor 12*a* without the need to increase the size of a main drive motor. The collator 10*a*** is, therefore, modular.

Also, since information about the size of the signatures in a particular signature pile support can be loaded into the memory of the associated motor drive controller, no declutching of the associated feeder or jogging of the conveyor is required to adjust the associated feeder to accommodate delivery of a different-sized signature onto the conveyor **12*a*. With the size information loaded into the memory, the associated motor drive controller is able to actuate the associated motor to adjust the associated feeder relative to the conveyor 12***a* when such an adjustment is desired. The adjustment is, therefore, relatively easy and requires no declutching of the feeder.

From the above description of the invention, those skilled in the art to which the present invention relates will perceive improvements, changes and modifications. Such improvements, changes and modifications within the skill of the art to which the present invention relates are intended to be covered by the appended claims.

Having described the invention, the following is claimed:

1. A collator comprising:

a collating conveyor;

a plurality of hopper sections located along said collating conveyor, each hopper section including (i) at least one signature pile support for holding signatures to be fed to said collating conveyor and (ii) signature feed means for feeding a signature from said at least one signature pile support to said collating conveyor;

each hopper section including its own respective drive motor for driving the associated signature feed means; and each drive motor including its own respective control means for controlling the associated drive motor to control the feeding of signatures from the associated signature feed means to said collating conveyor.

2. A collator according to claim 1 wherein at least one hopper section includes only one signature pile support for holding signatures to be fed to said collating conveyor.

3. A collator according to claim 1 wherein at least one hopper section includes a plurality of signature pile supports for holding signatures to be fed to said collating conveyor.

4. A collator according to claim 1 wherein each control means includes its own respective motor drive for controlling operation of the associated motor.

5. A collator according to claim 4 further comprising a master controller interconnecting said motor drives and for controlling speed of operation and coordinating timing of operation of said motor drives.

6. A collator according to claim 5 wherein each motor drive includes memory means for storing size information of the signatures in the signature pile supports of the respective hopper section.

7. A collator according to claim 6 wherein each motor drive includes means for processing the stored information to provide a signal which is applied to the associated motor to control operation of the motor.

8. A collator according to claim 7 wherein said master controller includes means for downloading information relating to the sizes of signatures from said master controller to each of said motor drives.

9. A collator according to claim 4 wherein each motor drive includes its own respective means for inhibiting operation of the associated motor to inhibit operation of the associated signature feed means.

10. A collator according to claim 1 further comprising means for enabling said signature feed means to be adjusted in a vertical direction toward and away from said collating conveyor.

11. A collator according to claim 1 further comprising means for enabling adjustment of said signature feed means of each hopper section relative to said collating conveyor in a vertical direction toward and away from said collating conveyor.

12. A collator according to claim 1 wherein each control means includes its own respective means for inhibiting operation of the associated drive motor to inhibit the associated signature feed means and thereby to inhibit feeding of signatures from the associated hopper section to said collating conveyor.

13. A collator according to claim 1 wherein each hopper section includes its own respective line drive shaft which is drivingly connected between the associated drive motor and the associated signature feed means.

14. A collator according to claim 13 wherein each control means controls the associated drive motor to drive the associated line drive shaft independently of line drive shafts associated with other hopper sections and thereby to control the feeding of signatures from the associated signature feed means of the associated hopper section to said collating conveyor independently of the feeding of signatures from the signature feed means associated with other hopper sections.

15. A collator according to claim 1 wherein each control means includes its own respective means for changing timing of operation of the associated drive motor relative to said collating conveyor to change timing of operation of the associated signature feed means relative to said collating conveyor and thereby to enable proper feeding of different-sized signatures to said collating conveyor.

16. A collator comprising:

a collating conveyor;

at least one of hopper section located along said collating conveyor, said hopper section including a plurality of signature pile supports for holding signatures to be fed to said collating conveyor;

each signature pile support having its own respective signature feed means for feeding a signature from the associated signature pile support to said collating conveyor;

each signature feeder means including its own respective drive motor for driving the associated signature feed means; and each drive motor including its own respective control means for controlling the associated drive motor to control the feeding of signatures from the associated signature feed means to said collating conveyor.

17. A collator according to claim 16 wherein each control means includes its own respective motor drive for controlling operation of the associated motor.

18. A collator according to claim 17 further comprising a master controller interconnecting said motor drives and for controlling speed of operation and coordinating timing of operation of said motor drives.

19. A collator according to claim 18 wherein each motor drive includes memory means for storing size information of the signatures in the associated signature pile support.

20. A collator according to claim 19 wherein each motor drive includes means for processing the stored information to provide a signal which is applied to the associated motor to control operation of the motor.

21. A collator according to claim 20 wherein said master controller includes means for downloading information relating to the sizes of signatures from said master controller to each of said motor drives.

22. A collator according to claim 17 wherein each motor drive includes its own respective means for inhibiting operation of the associated motor to inhibit operation of the associated signature feed means.

23. A collator according to claim 16 further comprising means for enabling said signature feed means to be adjusted in a vertical direction toward and away from said collating conveyor.

24. A collator according to claim 16 further comprising means for enabling adjustment of said signature feed means relative to said collating conveyor in a vertical direction toward and away from said collating conveyor.

25. A collator according to claim 16 wherein each control means includes its own respective means for inhibiting operation of the associated drive motor to inhibit the associated signature feed means and thereby to inhibit feeding of signatures from the associated signature pile support to said collating conveyor.

26. A collator according to claim 16 wherein each control means includes its own respective means for changing timing of operation of the associated drive motor relative to said collating conveyor to change timing of operation of the associated signature feed means relative to said collating conveyor and thereby to enable proper feeding of different-sized signatures to said collating conveyor.

* * * * *